US008639137B2

(12) United States Patent
Torimaru

(10) Patent No.: US 8,639,137 B2
(45) Date of Patent: Jan. 28, 2014

(54) IMAGE FORMING APPARATUS

(75) Inventor: Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 13/325,356

(22) Filed: Dec. 14, 2011

(65) Prior Publication Data

US 2012/0155897 A1 Jun. 21, 2012

(30) Foreign Application Priority Data

Dec. 16, 2010 (JP) ..... 2010-280198

(51) Int. Cl.
*G03G 15/00* (2006.01)

(52) U.S. Cl.
USPC ..... 399/44; 399/45; 399/51; 399/66

(58) Field of Classification Search
USPC ..... 399/44, 45, 51, 66, 302
See application file for complete search history.

(56) References Cited

U.S. PATENT DOCUMENTS 6,389,242 B1 5/2002 Watanabe
6,577,826 B1 * 6/2003 Misaizu et al. ..... 399/45
6,760,565 B2 7/2004 Watanabe et al.
6,834,176 B2 * 12/2004 Saito et al. ..... 399/302
2002/0164177 A1 11/2002 Watanabe et al.

FOREIGN PATENT DOCUMENTS

JP 2002-55541 A 2/2002
JP 2002-156839 A 5/2002
JP 2003-131494 A 5/2003
JP 2003-248388 A 9/2003
JP 2004-246074 A 9/2004
JP 2007-3714 A 1/2007

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an intermediary transfer member having an elastic layer; a toner image forming portion for forming a toner image for an image to be carried on the intermediary transfer member; a transfer member, which presses the intermediary transfer member, for transferring the toner image for the image from the intermediary transfer member onto a recording material; a pressing mechanism capable of changing pressure applied from the transfer member to the intermediary transfer member; and a controller for controlling the toner image forming portion so that a length of the toner image for the image on the intermediary transfer member with respect to a rotational direction of the intermediary transfer member is decreased with an increase of the pressure.

6 Claims, 11 Drawing Sheets

IMAGE FORMING APPARATUS

FIELD OF THE INVENTION AND RELATED ART

The present invention relates to an image forming apparatus in which a toner image is carried on an intermediary transfer member having an elastic layer and then is transferred onto a recording material. Specifically, the present invention relates to control for suppressing expansion and contraction of an image length with respect to a conveyance direction of an output image when pressure during transfer is changed to enhance a transfer efficiency.

The image forming apparatus in which the toner image is carried on the intermediary transfer member having the elastic layer and then is transferred onto the recording material has been widely used. The intermediary transfer member having the elastic layer is deformed in a thickness direction by pressure application to cancel unevenness of the recording material surface and therefore the intermediary transfer member can transfer the toner image with a high transfer efficiency even with respect to the recording material having a large surface roughness.

However, in recent years, a single image forming apparatus is required to meet recording materials of a wide variety of types from the recording material with a small surface roughness such as a glossy resin sheet to the recording material with a large surface roughness such as thick paper and cloth. In this case, with respect to the recording material having the large surface roughness, a degree of contactness (adhesion) is increased with an increase of pressure at a transfer portion to enhance the transfer efficiency but when the toner image is transferred onto the recording material having the small surface roughness at such high pressure, the transfer efficiency is considerably lowered (Japanese Laid-Open Patent Application (JP-A) 2003-131494).

This is because, with respect to the recording material having the small surface roughness, there is no space into which the pressure applied to the toner image can escape and therefore the toner image tends to adhere to a surface of an intermediary transfer belt and thus the toner image cannot be transferred onto the recording material by an electrical force applied to the transfer portion.

In JP-A 2003-131494, in view of such a problem, an image forming apparatus in which the pressure at a secondary transfer portion of the intermediary transfer belt having the elastic layer is variably changed is described. A cam mechanism is provided at a supporting portion of a rotation shaft of a secondary transfer, so that pressure depending on an angle of rotation of a cam is settable. The pressure at the secondary transfer portion is increased for thick paper but is lowered for coated paper or resin sheet.

However, when the pressure at the secondary transfer portion of the intermediary transfer belt having the elastic layer is changed, it was turned out that a length of the image with respect to a conveyance direction of the intermediary transfer belt is changed. When the pressure is increased, the image length tend to elongate, so that a trailing end of the image on the recording material is cut or a margin of the trailing end is narrowed and thus a quality of an output image is lowered.

SUMMARY OF THE INVENTION

A principal object of the present invention is to provide an image forming apparatus capable of enhancing reproducibility of a length of an image on a recording material with respect to a conveyance direction.

According to an aspect of the present invention, there is provided an image forming apparatus comprising: an intermediary transfer member having an elastic layer; toner image forming means for forming a toner image for an image to be carried on the intermediary transfer member; a transfer member, which presses the intermediary transfer member, for transferring the toner image for the image from the intermediary transfer member onto a recording material; a pressing mechanism capable of changing pressure applied from the transfer member to the intermediary transfer member; and control means for controlling the toner image forming means so that a length of the toner image for the image on the intermediary transfer member with respect to a rotational direction of the intermediary transfer member is decreased with an increase of the pressure.

These and other objects, features and advantages of the present invention will become more apparent upon a consideration of the following description of the preferred embodiments of the present invention taken in conjunction with the accompanying drawings.

Figure 3:
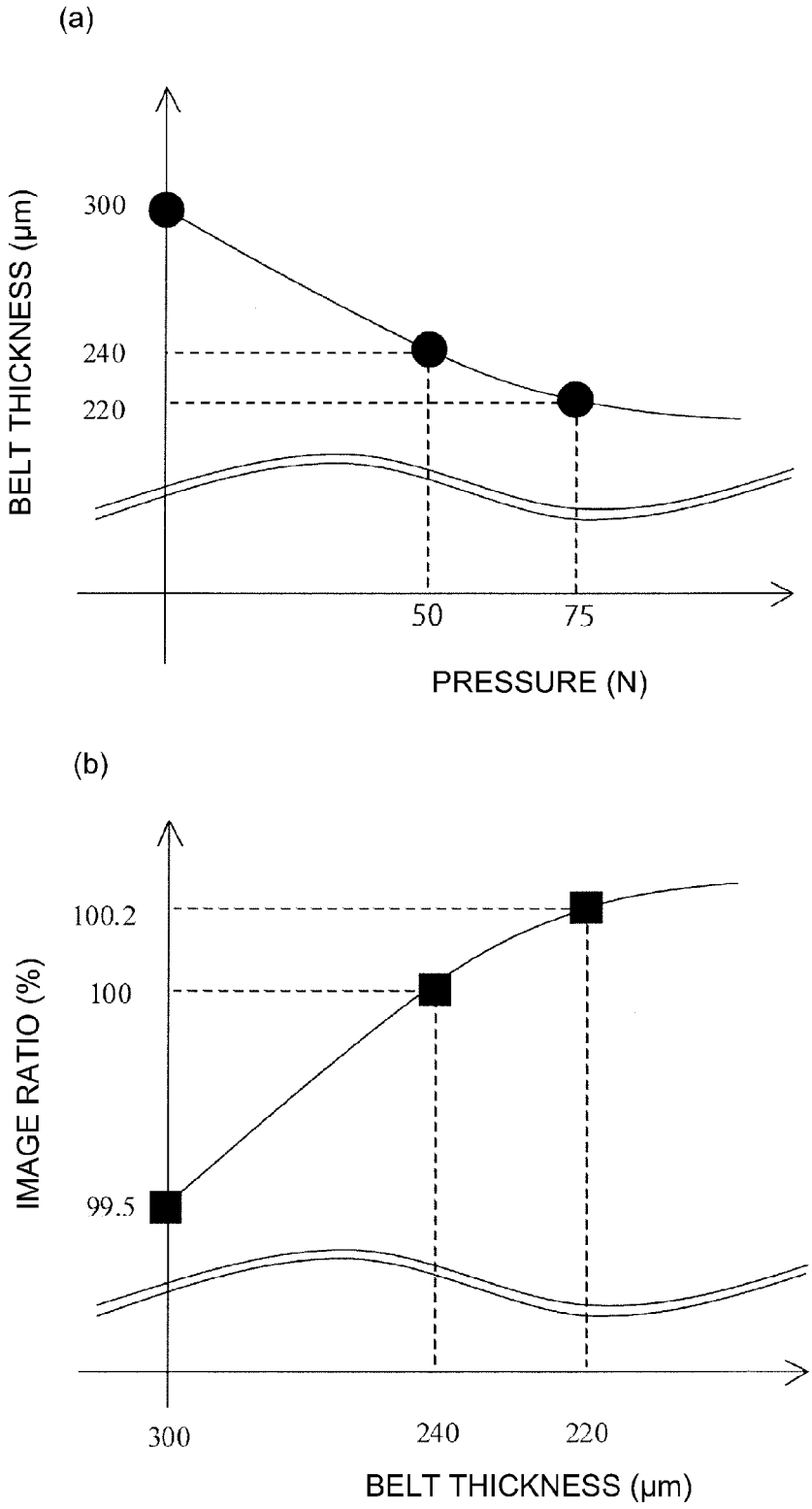

Parts (a) and (b) of FIG. 3 are illustrations showing a relationship between pressure at a secondary transfer portion and an image magnification (image ratio) with respect to a conveyance direction.

Figure 4:
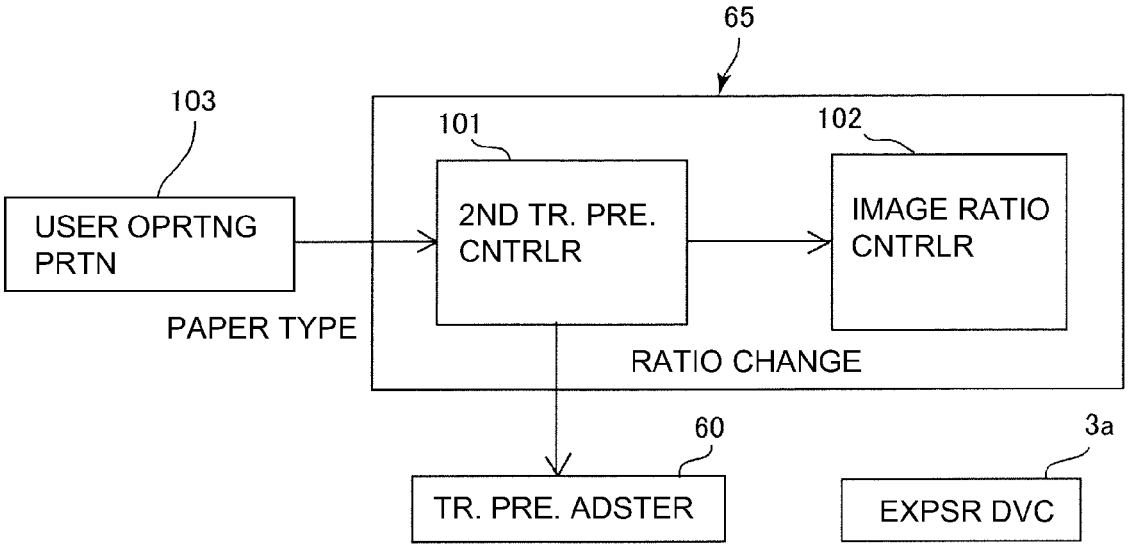

FIG. 4 is a block diagram of a control system in image magnification control in Embodiment 1.

Figure 5:
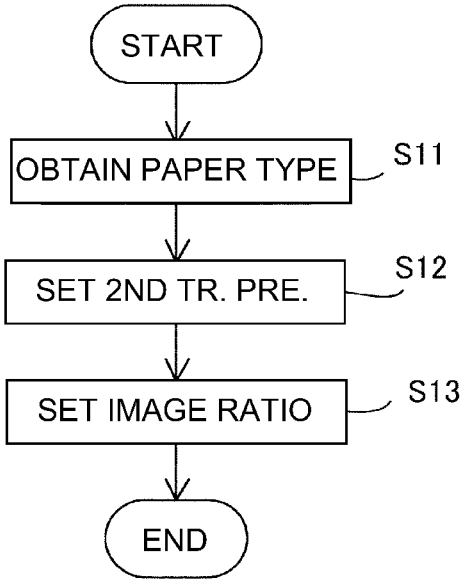

FIG. 5 is a flow chart of the image magnification control in Embodiment 1.

Figure 6:
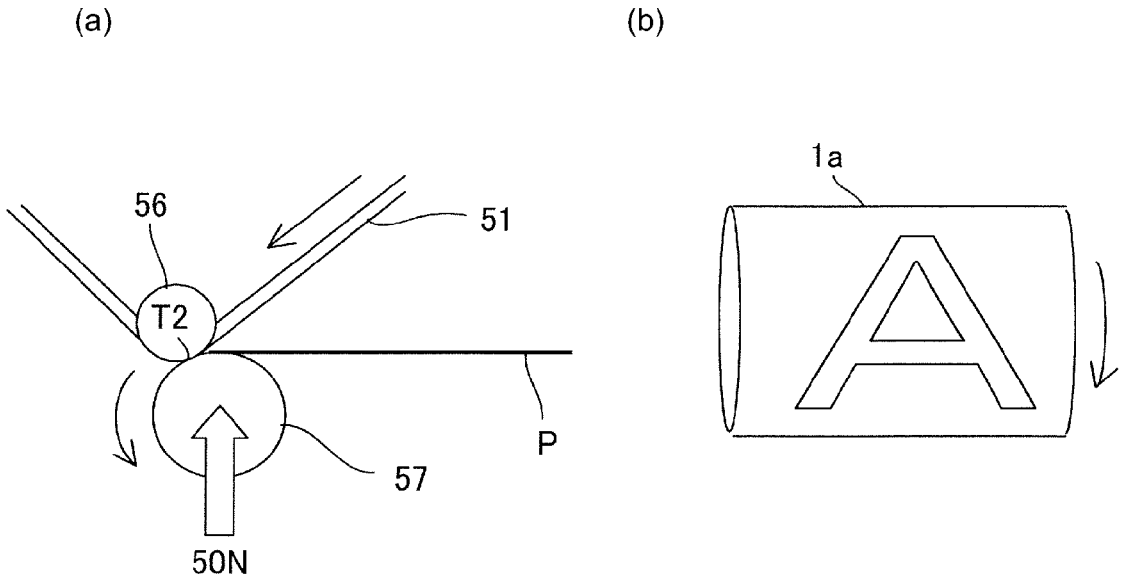

Parts (a) and (b) of FIG. 6 are illustrations of the secondary transfer portion when a toner image is transferred onto plain paper.

Figure 7:
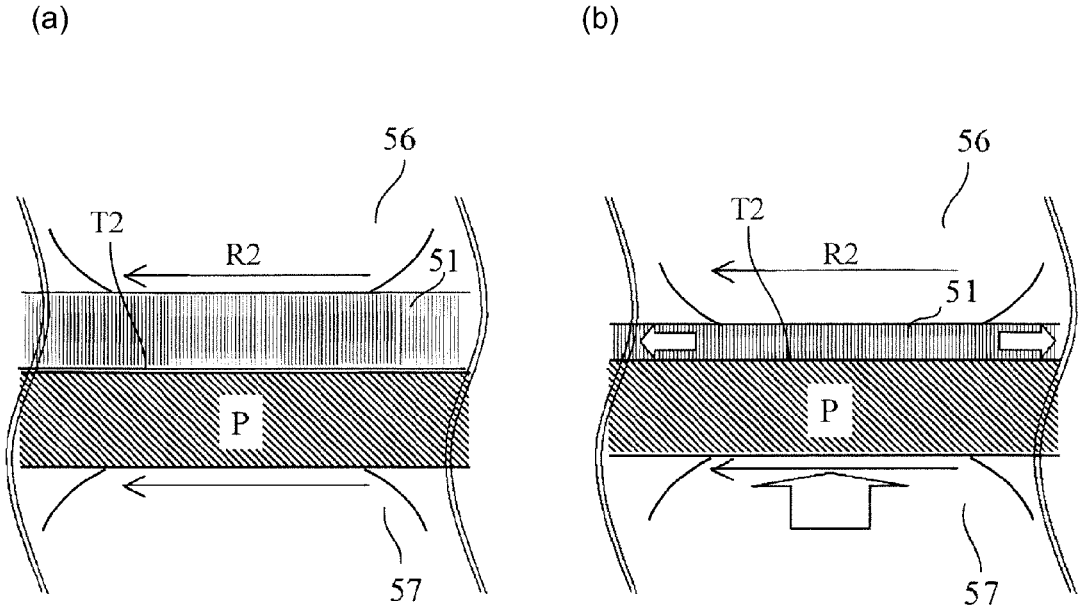

Parts (a) and (b) of FIG. 7 are illustrations of elongation of an image in the conveyance direction with an increase of pressure.

Figure 8:
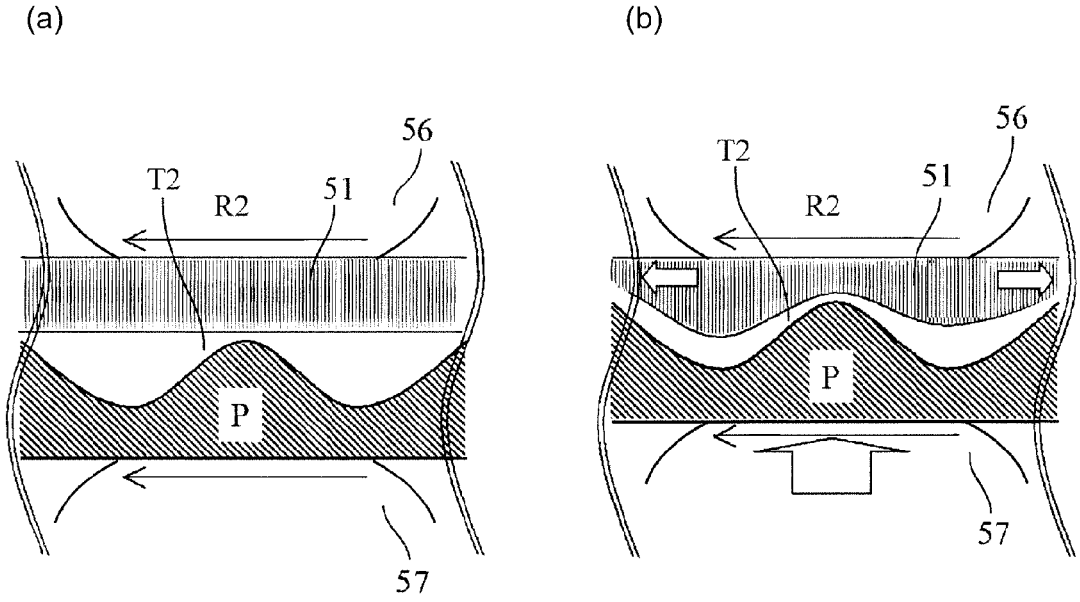

Parts (a) and (b) of FIG. 8 are illustrations of an improvement in adhesiveness to roughened paper with an increase of pressure.

Figure 9:
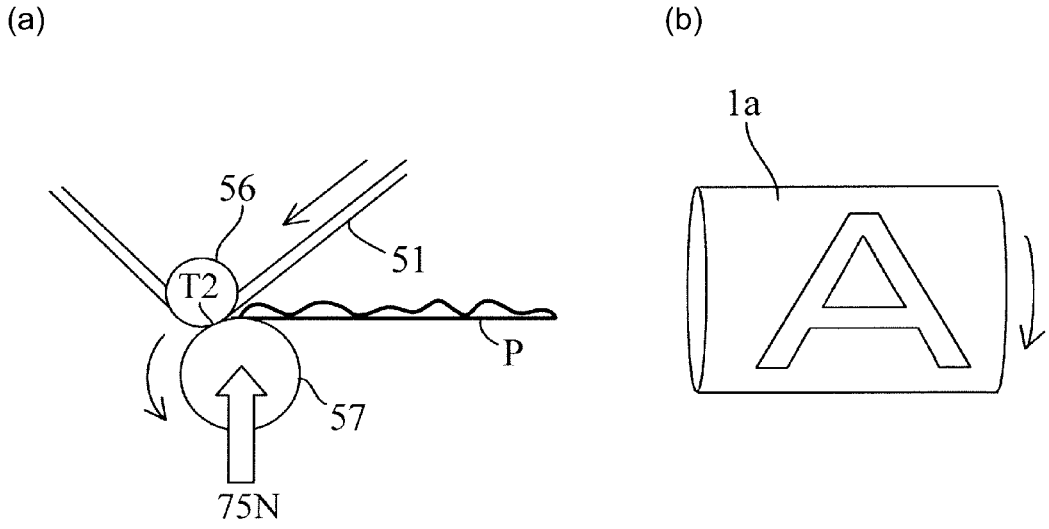

Parts (a) and (b) of FIG. 9 are illustrations of the secondary transfer portion when the toner image is transferred onto the roughened paper.

Figure 10:
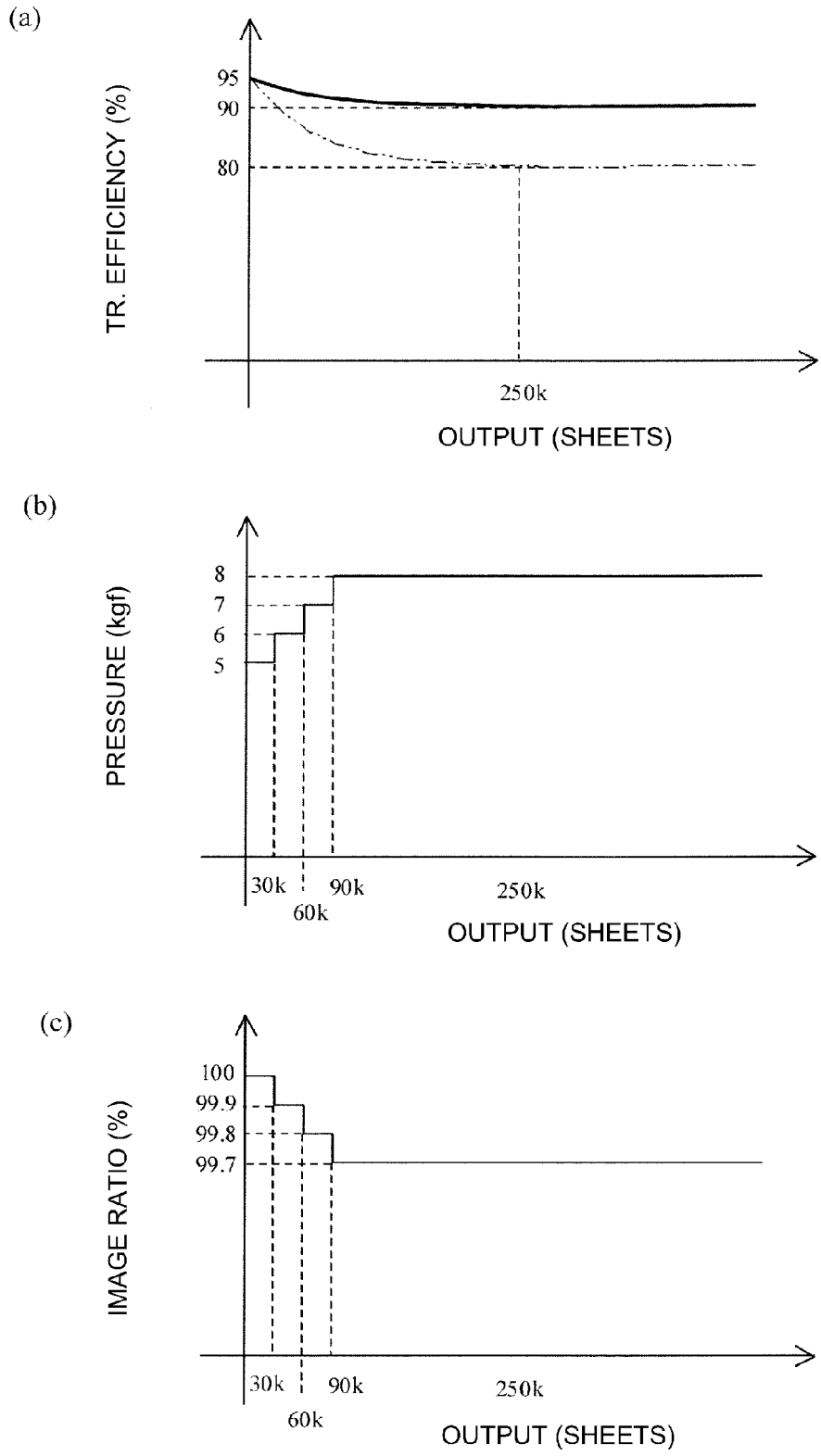

Parts (a) to (c) of FIG. 10 are illustrations of pressure and image magnification control in Embodiment 2.

Figure 11:
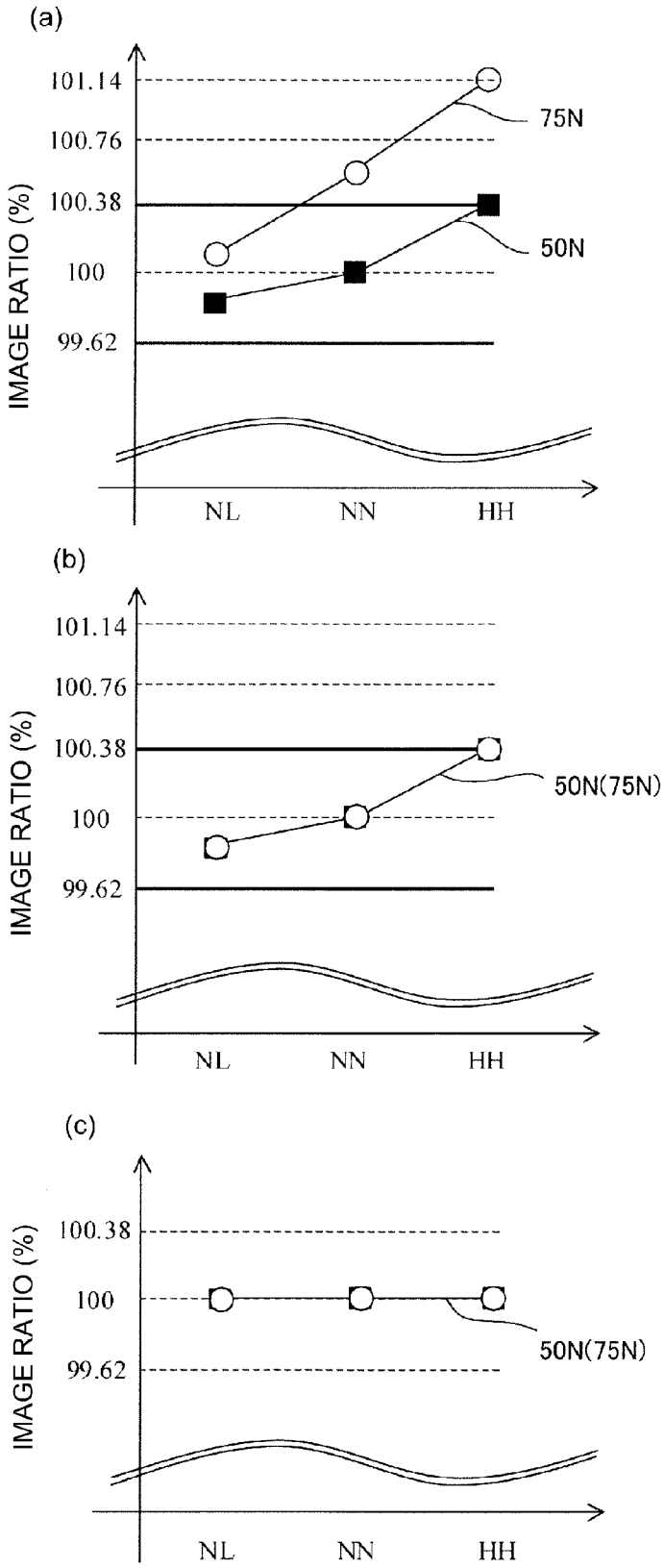

Parts (a) to (c) of FIG. 11 are illustrations of pressure and image magnification control in Embodiment 3.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as a length of a toner image carried on an intermediary transfer member with respect to a conveyance direction is shortened with an increase of pressure at a secondary transfer portion.

Therefore, the present invention can be carried out irrespective of constitution of an image forming portion in the case of an image forming apparatus in which an intermediary transfer member including an elastic layer is provided. The present invention can be carried out irrespective of types of monochromatic/full color, one-component developer/two-component developer, tandem/one-drum, and irrespective of methods of charging, exposure and fixing.

In the following embodiments, only a principal portion concerning formation/transfer of the toner image will be described but the present invention can be carried out in image forming apparatuses for various uses including printers, various printing machines, copying machines, facsimile machines, multi-function machines, and so on by adding necessary equipment, options, or casing structures.

<Image Forming Apparatus>

Figure 1:
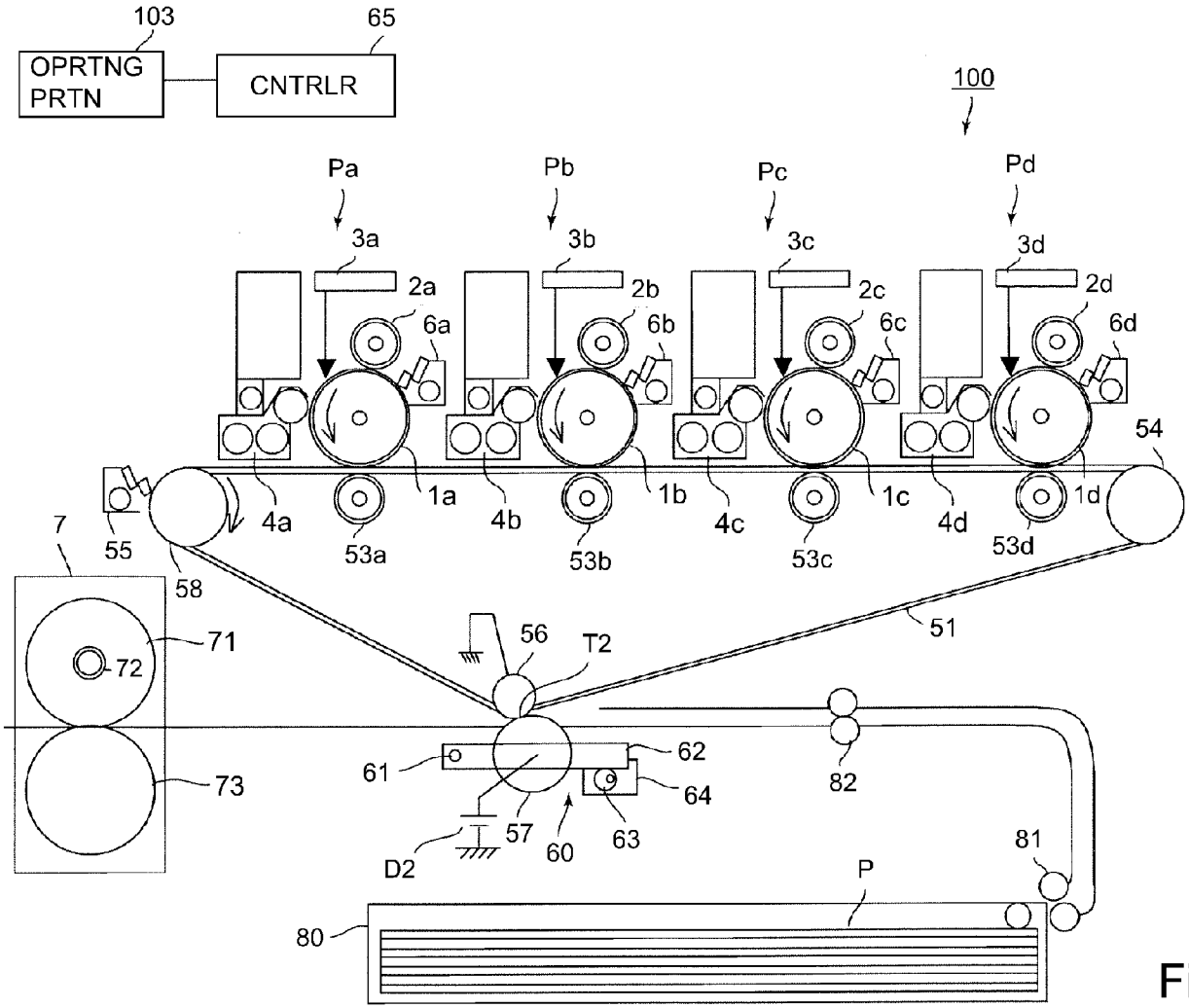
FIG. 1 is an illustration of a structure of an image forming apparatus.

FIG. 1 is an illustration of structure of an image forming apparatus.

As shown in FIG. 1, an image forming apparatus 100 in this embodiment is a tandem and intermediary transfer type full-color printer in which image forming portions Pa, Pb, Pc and Pd for yellow, magenta, cyan and black are arranged along an intermediary transfer belt 51.

In the image forming portion Pa, a yellow toner image is formed on a photosensitive drum 1*a* and then is primary-transferred onto the intermediary transfer belt 51. In the image forming portion Pb, a magenta toner image is formed on a photosensitive drum 1*b* and is primary-transferred onto the intermediary transfer belt 51. In the image forming portions Pc and Pd, a cyan toner image and a black toner image are formed on photosensitive drums 1*c* and 1*d*, respectively, and are successively primary-transferred onto the intermediary transfer belt 51.

The recording material P is pulled out from a recording material cassette 80 and is separated one by one by a separation roller 81. A registration roller 82 once stops the recording material P and feeds the recording material P to a secondary transfer portion T2 in synchronism with timing of the toner images on the intermediary transfer belt 51.

The four color toner images transferred on the intermediary transfer belt 51 are conveyed to the secondary transfer portion T2 and are superposed on the recording material P, thus being nip-conveyed through the secondary transfer portion T2. During the nip-conveyance, a transfer power source D2 applies a transfer voltage to a secondary transfer roller 57, so that the toner images are transferred from the intermediary transfer belt 51 onto the recording material P. Transfer residual toner remaining on the intermediary transfer belt 51 is collected by a belt cleaning device 55.

The recording material P on which the four color toner images are transferred is curvature-separated from the intermediary transfer belt 51 and is conveyed to a fixing device 7, in which the toner images are heated and pressed and thus are fixed on the recording material P. Thereafter, the recording material P is discharged to the outside of the image forming apparatus 100. The fixing device 7 nip-conveys the recording material P, on which unfixed toner images are carried, through a nip between a heating roller 71 and a pressing roller 73. The toner images are melted by pressure of the pressing roller 73 and heating by a heater 72 provided in the heating roller 71 and thus are fixed on the surface of the recording material P.

The image forming portions Pa, Pb, Pc and Pd have the substantially same constitution except that the colors of toners of yellow, cyan, magenta and black used in developing devices 4*a*, 4*b*, 4*c* and 4*d* are different from each other. In the following description, the image forming portion Pa for yellow will be described and with respect to other image forming portions Pb, Pc and Pd, the suffix a of reference numerals (symbols) for representing constituent members (means) is to be read as b, c and d, respectively, for explanation of associated ones of the constituent members.

The image forming portions Pa includes the photosensitive drum 1*a*. Around the photosensitive drum 1*a*, a charging roller 2*a*, an exposure device 3*a*, the developing device 4*a*, a primary transfer roller 53*a*, and a drum cleaning device 6*a* are disposed. The photosensitive drum 1*a* is constituted by a metal cylinder on which a photosensitive layer having a negative charge polarity is formed at a surface of the metal cylinder and is rotated in an arrow R1 direction at a process speed of 300 mm/sec.

To the charging roller 2*a* which is rotated by the photosensitive drum 1*a* in contact with the photosensitive drum 1*a*, an oscillating voltage in the form of a DC voltage based with an AC voltage is applied, so that the surface of the photosensitive drum 1*a* is electrically charged.

The exposure device 3*a* writes (forms) an electrostatic image for an image on the charged surface of the photosensitive drum 1*d* by scanning of the charged surface through a polygonal mirror with a laser beam obtained by ON/OFF modulation of scanning line image data expanded from yellow component image data.

The developing device 4*a* reversely develops the electrostatic image with a two-component developer containing a toner and a carrier, so that the toner image is formed on the photosensitive drum 1*a*.

The primary transfer roller 53*a* contacts an inner surface of the intermediary transfer belt 51 to form a primary transfer portion T1 between the photosensitive drum 1*a* and the intermediary transfer belt 51. To the primary transfer roller 53*a*, a DC voltage of an opposite polarity (positive) to a charge polarity of the toner is applied, so that the toner image carried on the photosensitive drum 1*a* is primary-transferred onto the intermediary transfer belt 51. The drum cleaning device 6*a* rubs the photosensitive drum 1*a* with a cleaning blade to collect the transfer residual toner.

<Intermediary Transfer Belt>

Figure 2:
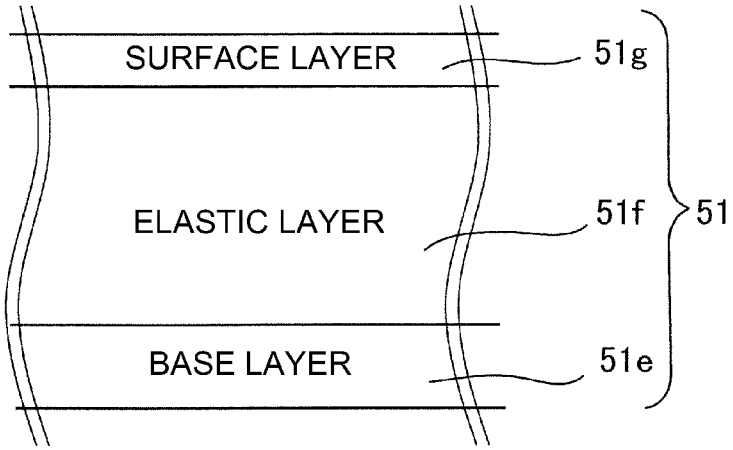
FIG. 2 is an illustration of a cross-sectional structure of an intermediary transfer belt.

FIG. 2 is an illustration of a cross-sectional structure of the intermediary transfer belt 51. As shown in FIG. 1, the intermediary transfer belt 51 is stretched and supported by a belt driving roller 54, a tension roller 58, a secondary transfer opposite roller 56 and the primary transfer rollers 53*a*, 53*b*, 53*c* and 53*d*. To the intermediary transfer belt 51, a predetermined tension is applied by the tension roller 58, and the intermediary transfer belt 51 is driven by the belt driving roller 54 and is rotated in an arrow R2 direction at the above-described process speed.

As shown in FIG. 2, the intermediary transfer belt 51 is prepared by forming an elastic layer 51*f* of a soft rubber material on a base layer 51*e* of a hard resin material and then by coating the surface of the elastic layer 51*f* with a surface layer 51*g* of a fluorine-containing material which is not readily contaminated.

A total thickness of the base layer 51*e*, the elastic layer 51*f* and the surface layer 51*g* is 300-400 μm. The base layer 51*e* of the intermediary transfer belt 51 is 50-100 μm in thickness. The elastic layer 51*f* of the intermediary transfer belt 51 is 300-300 μm in thickness and is 60 degrees in hardness in terms of Asker-C hardness (JIS). The surface layer 51*g* of the intermediary transfer belt 51 is 1-10 μm in thickness.

The intermediary transfer belt 51 is $1\times10^{8}$–$1\times10^{13}$ Ω/□ in surface electric resistivity and is $1\times10^{6}$–$1\times10^{12}$ Ω·cm in volume resistivity. The volume resistivity was measured in an environment of a temperature of 23° C. and a relative humidity of 50% RH under a condition of 100 V in applied voltage and 10 sec in application time. The intermediary transfer belt 51 is manufactured in the following manner.

(1) While rotating a cylindrical metal mold, a material constituting the base layer 51*e* is continuously supplied from a nozzle to an outer surface of the mold and simultaneously the nozzle is moved in a rotational axis direction of the mold to uniformly apply the material. Then, the material is cured to form the base layer 51*e*. In order to improve a parting property of the mold, a parting (releasing) material such as silicone oil may be applied to the mold surface, or the mold may be coated with a ceramic material. The nozzle is provided with a pipe-like liquid ejection outlet and is about 0.3-3.0 mm in wall thickness.

(2) Next, in the same manner, the elastic layer 51*f* is formed on the base layer 51*e*.

(3) Thereafter, the surface layer 51*g* is coated on the elastic layer 51*f* by spray coating (painting). During the painting, it is preferable that an aqueous fluorine-containing rubber paint formed with a fluorine-containing rubber emulsion or a solvent-type fluorine-containing rubber paint in which fluorine-containing rubber is dissolved in an organic solvent is used.

The material constituting the base layer 51*e* is not particularly limited so long as the material can possess a necessary physical property but may preferably be a resin material. The resin material capable of constituting the base layer 51*e* may include polyimide resin, polyamideimide resin, polyetherimide resin, siliconeimide resin, urethaneimide resin, polyurethane resin, polyurea resin, epoxy resin, melamine resin, unsaturated polyester resin, vinyl ester resin, and the like. As an electron conductive agent contained in the material for constituting the base layer 51*e*, an electron conductive material such as carbon black, electroconductive metal oxide or carbon fiber is used.

The elastic layer 51*f* may be either of elastomer having ion conductivity or elastomer having electron conductivity so long as the elastomer has the volume resistivity in the above-described certain range. As the elastomer having the ion conductivity, a known ion conductive rubber can be used and it is also possible to use elastomer in which an ion conductive agent is added. In the case where the electron conductive agent is added in the elastomer for constituting the elastic layer 51*f*, similarly as in the case of the base layer 51*e*, it is also possible to add the electron conductive material such as carbon black, electroconductive metal oxide or carbon fiber.

Examples of the ion conductive rubber may include a composition containing a rubber material, having a polar group, such as acrylonitrile butadiene rubber or epihalohydrin rubber (particularly epichlorohydrin rubber). Examples of the ion conductive agent may include tetraethyl-ammonium, tetrabutyl-ammonium, dodecyltrimethyl-ammonium, and the like. It is also possible to use salts of these ammoniums, such as perchlorate, chlorate, hydrochloride, bromate, iodate, fluoroboric acid salt, sulfate, alkyl sulfate, carboxylate, sulfonate, and the like.

<Secondary Transfer Roller>

As shown in FIG. 1, at the secondary transfer portion T2, the secondary transfer roller 57 is contacted to the outer surface of the intermediary transfer belt 51 supported by the secondary transfer opposite roller 56. The recording material P is nip-conveyed through the secondary transfer portion T2 formed between the intermediary transfer belt 51 and the secondary transfer roller 57. The secondary transfer opposite roller 56 is grounded, and the secondary transfer roller 57 is connected to the transfer power source D2. The secondary transfer roller 57 is 24 mm in outer diameter, and the secondary transfer opposite roller 56 is 20 mm in outer diameter.

The secondary transfer roller 57 has a structure of two or more layers including an ion conductive elastic rubber layer of urethane rubber or the like, and including a surface layer. The elastic rubber layer is a foam layer which contains carbon black dispersed therein and is 0.05-1.0 mm in cell diameter. The surface layer is formed of fluorine-containing resin material in which an ion conductive polymer is dispersed and has a thickness of 0.1-1.0 mm.

The surface hardness of the secondary transfer roller 57 is adjusted at 20-40 degrees in terms of the Asker-C hardness. Further, in consideration of a secondary transfer property, the resistance value of the secondary transfer roller 57 may desirably be $1\times10^6\Omega$ or more and $1\times10^9\Omega$ or less. In this embodiment, the resistance value of the secondary transfer roller 57 was $1\times10^7\Omega$.

The resistance value of the secondary transfer roller 57 was measured in the following manner. The secondary transfer roller 57 is contacted at a total load of 9.8N to a resistance value-measuring roller of aluminum which is grounded via an ammeter and is 20 mm in diameter, and the measuring roller is rotationally driven at a rotational speed of 20 rpm. The secondary transfer roller 57 is rotated by the rotation of the measuring roller at the same peripheral speed and is supplied with a voltage of 2 kV at its metal shaft portion to measure a current value I(A), so that a resistance value R is calculated from the following equation.

$$R=2\text{ kV}/I(A)$$

<Transfer Pressure Adjusting Mechanism>

At the secondary transfer portion T2, by the action of pressure and electric field, the toner image on the intermediary transfer belt 51 is transferred onto the recording material P. However, smoothness of the surface of the recording material P on which the toner image is transferred varies depending on the type of the recording material P. When the toner image is transferred onto the recording material P having poor surface smoothness such as thick paper, there is a need to apply higher pressure to the secondary transfer portion T2 to bring the intermediary transfer belt 51 into intimate contact with the surface of the recording material P. When the pressure is insufficient, the intimate contactness between the recording material P and the intermediary transfer belt 51 is liable to become poor. Thus, improper transfer of the toner image is caused.

On the other hand, when the toner image is transferred onto the recording material having a good surface smoothness such as coated paper or an OHP sheet, under application of excessively large pressure, the improper transfer is liable to occur at a central portion of a line image or a line constituting a character image. This is because the toner at the central portion of the line agglomerates by the excessive acting on the toner image during the transfer and the agglomerated toner is not completely transferred onto the recording material P and is moved toward the intermediary transfer belt 51.

Therefore, in the image forming apparatus 100, a transfer pressure adjusting mechanism 60 is provided in the neighborhood of the secondary transfer portion T2, so that the pressure of the secondary transfer roller 57 applied to the intermediary transfer belt 51 supported by the secondary transfer opposite roller 56 can be adjusted. The secondary transfer roller 57 is rotatably mounted on a rotational movement frame 62 which is rotatably supported by a rotation shaft 61.

A controller 65 rotates the rotational movement frame 62 about the rotation shaft 61 by rotating a pressing cam 63 to move the secondary transfer roller 57 upward and downward, thus changing the pressure at the secondary transfer portion T2.

The secondary transfer portion T2 is constituted as described above, and the controller 65 sets the pressure at the secondary transfer portion T2 depending on the type of the recording material P designated by a user. With respect to the thick paper, the pressure is increased to enhance the transfer efficiency, and with respect to the coated paper, the pressure is lowered to prevent dropout of the line image.

However, in the image forming apparatus 100, it was turned out that there is a problem peculiar to the case of the intermediary transfer belt 51 having the elastic layer 51*f*. With an increase of pressure at the secondary transfer portion T2, an image magnification (image ratio) of the toner image transferred on the recording material P is increased. In the case where printing on a so-called roughened paper such as the thick paper with large surface roughness is required, the pressure at the secondary transfer portion T2 is largely increased. This is because at the low pressure, as shown in FIG. 8, the elastic layer 51*f* cannot sufficiently enter a recessed portion of the recording material surface, so that a transfer property at the recessed portion is liable to become insufficient.

Further, an experiment in which the pressure at the secondary transfer portion T2 is made larger than normal pressure and the toner image is transferred onto the roughened paper was conducted, there arose a problem such that the image was elongated in the conveyance direction to increase the image magnification with respect to the conveyance direction.

Therefore, in the following embodiments, a length of the toner image, with respect to the conveyance direction, formed on the photosensitive drum 1*a* is shortened with a higher se value of the pressure at the secondary transfer portion T2. Depending on the paper type selected by the user, the pressure at the secondary transfer portion T2 is changed and at the same time, the image magnification is controlled at a stage of the elastic layer depending on the pressure. As a result, a change of a final image magnification on the recording material P is reduced while enhancing the transfer efficiency with respect to the recording materials of various types.

Embodiment 1

Parts (a) and (b) of FIG. 3 are illustrations showing a relationship between pressure at a secondary transfer portion and an image magnification (image ratio) with respect to a conveyance direction. FIG. 4 is a block diagram of a control system in image magnification control in Embodiment 1. FIG. 5 is a flow chart of the image magnification control in Embodiment 1.

As shown in FIG. 1, the image forming portion Pa which is example of a toner image forming means forms the toner image for the image and carries the toner image on the intermediary transfer belt 51 which is an example of an intermediary transfer member having the elastic layer. The secondary transfer roller 57 which is an example of a transfer member is press-contacted to the intermediary transfer belt 51 which is an example of the intermediary transfer member to form the secondary transfer portion T2 which is an example of a transfer portion where the toner image is transferred onto the recording material. The transfer power source D2 which is an example of a power source means applies the voltage to the secondary transfer portion T2, so that the toner image is transferred from the intermediary transfer belt 51 onto the recording material P.

The transfer pressure adjusting mechanism 60 which is an example of a pressing (urging) mechanism is capable of changing the pressure applied from the secondary transfer roller 57 to the intermediary transfer belt 51. The controller 65 which is an example of a control means controls the exposure device 3*a* so that the length of the toner image for the image with respect to the rotational direction of the intermediary transfer belt 51 is shortened with the increase of pressure at the secondary transfer portion T2. With a larger surface roughness of the recording material P, the controller 65 increases the pressure at the secondary transfer portion T2 and shortens the length of the toner image for the image with respect to the rotational direction of the intermediary transfer belt 51. With respect to the recording material having embossed surface unevenness, compared with the plain paper, the pressure at the secondary transfer portion T2 is increased and the length of the toner image for the image with respect to the rotational direction of the intermediary transfer belt 51 is shortened.

In this embodiment, the intermediary transfer belt 51 used includes a 2 μm-thick surface layer, a 213 μm-thick elastic layer and a 85 μm-thick and is 300 μm in total thickness. The base layer 51*e* of the intermediary transfer belt 51 has the Young's modulus of about 3 GPa and the paper is about 4 GPa in Young's modulus and is hard, so that when the pressure is increased at the secondary transfer portion T2, deformation is little observed.

However, the Young's modulus of the elastic layer 51*f* of the intermediary transfer belt 51 is about 1-10 MPa which is low since the rubber material is used. In this embodiment, the urethane rubber is used for the elastic layer 51*f* and therefore the Young's modulus is 8 MPa.

For this reason, the elastic layer 51*f* located between the base layer 51*e* and the recording material 51*f* is largely changed when the pressure at the secondary transfer portion T2 is increased, so that the surface of the intermediary transfer belt 51 follows the surface unevenness of the recording material P.

As shown in (a) of FIG. 3, with the increase of the pressure at the secondary transfer portion, the total thickness of the intermediary transfer belt 51 is lowered and when the pressure is about 900 N (9 kgf), the total thickness is saturated.

As shown in (b) of FIG. 3, the thickness of the intermediary transfer belt 51 is decreased with the increase of pressure, so that the image magnification with respect to the conveyance direction after the transfer is increased. With the decrease of the thickness of the intermediary transfer belt 51, the image magnification is increased and it is understood that the image magnification is saturated at about 100.25% when the thickness is about 210 μm.

As shown in FIG. 5 with reference to FIG. 4, in the image magnification control in this embodiment, the controller 65 first obtains paper type information from setting by the user through a user operating portion 103 (S11). On the basis of the obtained paper type information, the controller 65 judges whether or not the recording material is paper, such as recycled paper or roughened paper, for which transferability is improved by increasing the pressure at the secondary transfer portion T2 (S12).

An image magnification controller 102 sets, in the case of the recording material (plain paper) for which there is no need to increase the pressure, the image magnification at a default and then forms an electrostatic image with a length of 100% with respect to the conveyance direction by the exposure device 3*a* (S13).

However, in the case of the recording material (roughened paper) for which there is a need to increase the pressure, the image magnification controller 102 controls the exposure device 3*a* so that a final image magnification on the recording material P is equal to the default to form the electrostatic image with a shortened length of, e.g., 99.6% with respect to the conveyance direction (S13). In this embodiment, as the roughened paper, embossed paper ("LEATHAC 66", (registered trademark), basis weight: 116 g/m$^2$) was used.

<In the Case of Plain Paper>

Parts (a) and (b) of FIG. 6 are illustrations of the secondary transfer portion when the toner image is transferred onto the plain paper. Parts (a) and (b) of FIG. 7 are illustrations of an image elongation in the conveyance direction with the increase of pressure. Parts (a) and (b) of FIG. 8 are illustrations of an improvement in adhesiveness to roughened paper with an increase of pressure. Parts (a) and (b) of FIG. 9 are illustrations of the secondary transfer portion when the toner image is transferred onto the roughened paper.

As shown in FIG. 6, in the case where the plain paper is passed through the secondary transfer portion T2, on the photosensitive drum 1*a*, the electrostatic image with the image magnification of 100% with respect to an image size of an inputted image is formed. The peripheral speed of the photosensitive drum 1*a* is 300 mm/sec, and the load exerted on the secondary transfer roller 57 in the case where the recording material P to be passed is the plain paper is 50 N (5 kgf). Further, the electrostatic image is formed on the photosensitive drum 1*a* so that a size thereof corresponds to A3-sized paper, i.e., 416 mm±0.21 mm in length with a margin of 2 mm at each of leading and trailing ends. That is, the image on the recording material is about 1 (100%).

As shown in (a) of FIG. 7, in the case of the plain paper, the pressure by the secondary transfer roller 57 is set at 50 N (5 kgf). The intermediary transfer belt 51 moves in an arrow R2 direction and the image magnification in the case of the pressure of 50 N is taken as a reference value. The transfer efficiency of the toner image with a maximum toner amount (200%) when the secondary transfer voltage is optimized is 90%.

As shown in (b) of FIG. 7, when the pressure by the secondary transfer roller 57 is increased to 75 N (7.50 kgf), the image magnification with respect to the conveyance direction is increased. When the pressure is increased, the rubber material of the elastic layer 51*f* is elongated in the conveyance direction. The thickness of 240 μm for the elastic layer 51*f* in (a) of FIG. 7 is changed to 220 μm in (b) of FIG. 7, with the result that a degree of elongation of the toner image with respect to the conveyance direction is 100.2% at the secondary transfer portion T2. Accumulation of such an elongation contributes to the image magnification with respect to the conveyance direction (sub-scan direction). As a result, in A3 size portrait-oriented feeding, the elongation of about 1 mm with respect to the conveyance direction is generated.

However, in the case of the plain paper, when the pressure by the secondary transfer roller 57 is increased to 75 N (7.50 kgf), dropout of the character image becomes conspicuous and even when the secondary transfer voltage is optimized, the toner image transfer efficiency is considerably lowered.

<In the Case of Roughened Paper>

As shown in (a) of FIG. 8, compared with the plain paper, in the case of the roughened paper with large surface roughness, when the pressure by the secondary transfer roller 57 is kept at 50 N (5 kgf), the transfer efficiency is lowered. The roughened paper used in this embodiment has a groove depth of about 80 μm at its surface embossed in a leather fashion. In this case, when the pressure at the secondary transfer portion T2 is 50 N (5 kgf), an amount of following in which the surface of the intermediary transfer belt 51 enters the groove of the roughened paper is about 20 μm at the most, so that the toner image transfer efficiency was lowered to about 60%.

As shown in FIG. 9, in the case where the rotational direction is passed through the secondary transfer portion T2, in order to restore the lowered transfer efficiency, the pressure applied to the secondary transfer roller 57 is 75 N (7.50 kgf) which is 1.5 times that in the case of passing the plain paper. Further, in order to cancel the toner image elongation in the conveyance direction on the intermediary transfer belt 51 due to the increase of the pressure, the electrostatic image on the photosensitive drum 1*a* is formed with the image magnification of 99.6% with respect to the image size of the inputted image. The electrostatic image on the photosensitive drum 1*a* is formed with a length of 414 mm±0.21 mm with a margin of 2 mm at its leading end trailing ends with respect to the conveyance direction by increasing a main scan speed of the exposure device 3*a*. Incidentally, the peripheral speed of the photosensitive drum 1*a* is 300 mm/sec equal to that in the case of the plain paper.

As a result, during the recording material conveyance in A3 portrait-oriented feeding, the toner image is formed on the photosensitive drum 1*a* so as to have a length of 416 mm±0.22 mm with a margin of 2 mm at its leading and trailing ends after the secondary transfer. That is, even when the length of the electrostatic image with respect to the conveyance direction per the length of the inputted image with respect to the conveyance direction is shortened to 99.6%, through the secondary transfer, the image magnification on the recording material is about 1, so that the image magnification is the same as that in setting in the case of passing the plain paper.

As shown in (b) of FIG. 8, in the case where the pressure by the secondary transfer roller 57 is 75 N (7.50 kgf), the elastic layer 51*f* located between the base layer 51*e* and the recording material P is largely deformed when the pressure at the secondary transfer portion T2 is increased, so that the followability to the recessed portion is increased to improve the transfer property. The roughened paper (embossed paper, "LEATHAC 66", basis weight: 116 g/m$^2$) in this embodiment is about 80 μm in embossed groove depth as described above.

In this case, by increasing the pressure at the secondary transfer portion T2 to 75 N (7.50 kgf), the followability is increased to 40 μm and thus the transfer efficiency is about 75% which is higher by about 15% than that in the case of the pressure of 50 N (5 kgf).

As described above, in the secondary transfer control in this embodiment, in order to improve the transfer property with respect to the recording material, such as the recycled paper or the roughened paper, with the large surface unevenness, the pressure at the secondary transfer portion T2 is increased in the image forming apparatus 100 using the intermediary transfer belt 51 having the elastic layer 51*f*. However, when the pressure at the secondary transfer portion T2 is increased, the image magnification with respect to the conveyance direction is increased and therefore control such that the length of the electrostatic image with respect to the conveyance direction is shortened to provide the image length equal to the default on the recording material is effected.

Incidentally, in this embodiment, based on the relationship between the peripheral speed of the photosensitive drum 1*a* and the main scan speed of the exposure device 3*a*, the image length to the length of the inputted image with respect to the conveyance direction was adjusted. However, the image length with respect to the conveyance direction may also be adjusted by changing a density of the scanning lines with respect to the sub-scan direction in a process in which the image data is developed into the scanning line signal.

Further, in this embodiment, at a constant peripheral speed of the photosensitive drum 1*a*, by increasing the main scan speed of the exposure device 3*a*, the length of the electrostatic image, relative to the inputted image, formed on the photosensitive drum 1*a* with respect to the conveyance direction is shortened. However, also by slowing the peripheral speed of the photosensitive drum 1*a* while keeping the main scan speed of the exposure device 3*a*, similarly, it is possible to shorten the length of the electrostatic image formed on the photosensitive drum 1*a*.

Further, in this embodiment, the peripheral speeds of the photosensitive drum 1*a* and the intermediary transfer belt 51 were set at the same value. However, also by setting the peripheral speed of the intermediary transfer belt 51 at a value relatively lower than that of the photosensitive drum 1*a*, similarly, the length of the electrostatic image formed on the photosensitive drum 1*a* with respect to the conveyance direction can be shortened. Therefore, the control of the image magnification on the recording material with respect to the sub-scan direction may also be effected based on the peripheral speed difference at the primary transfer portion. Similarly, the control of the image magnification on the recording material with respect to the sub-scan direction may also be effected based on the peripheral speed difference at the secondary transfer portion.

Further, in this embodiment, the control in which the electrostatic image length with respect to the conveyance direction is shortened with a higher pressure image forming condition at the secondary transfer portion to uniformize the image length on the recording material with respect to the conveyance direction at a certain value is described. However, the elongation of the image on the recording material when the pressure is increased similarly occurs also with respect to a direction (main scan direction) perpendicular to the recording material conveyance direction. For this reason, the length of the electrostatic image with respect to the widthwise direction may also be set at a small value with the increase of pressure.

Embodiment 2

Parts (a) to (c) of FIG. 10 are illustrations of control of the pressure and the image magnification in Embodiment 2. In this embodiment, in the image forming apparatus 100 shown in FIG. 1, control in which the pressure at the secondary transfer portion T2 is increased depending on a cumulative image formation sheet number is introduced. Further, similarly as is Embodiment 1, the electrostatic image formation length with respect to the conveyance direction is shortened, so as to cancel the elongation of the toner image during the secondary transfer, with the increase of pressure. A basic constitution in this embodiment is the same as that in Embodiment 1 and therefore the same constituent portions (means) as those in Embodiment 1 are represented by the same reference numerals or symbols and will be omitted from redundant description. A characteristic portion in this embodiment will be described below.

The controller 65 increases the pressure at the secondary transfer portion T2 and shorten the length of the toner image for the image with respect to the rotational direction of the intermediary transfer belt 51, with the increase of a cumulative output sheet number for image formation.

As shown in (a) of FIG. 10, with the increase of the cumulative output sheet number (durability sheet number) for image formation, as indicated by a chain double-dashed line, the transfer efficiency of the toner image at the secondary transfer portion T2 is lowered. The image forming condition is such that the image ratio is 10% when the image ratio of a whole area image with a single color maximum gradation level is 100% and that the type of the recording material is A4-sized recycled paper. In the case where the pressure at the secondary transfer portion T2 is kept at 50 N (5 kgf), as indicated by the chain double-dashed line, the secondary transfer efficiency of the toner image is lowered with the increase of the cumulative output sheet number. At an initial stage, the transfer efficiency is 95% but is exponentially lowered with the increase of the cumulative output sheet number. Then, it is understood that the transfer efficiency is saturated at the sheet number of about 250 K (250,000) sheets, i.e., is lowered to about 80%.

The reason why this embodiment is lowered is such that when the continuous image formation with the low image ratio is effected, the developer in the developing device 4*a* is deteriorated. That is, the developer is continuously stirred for a long time in the developing device 4*a*, so that the depositing force of the toner on the intermediary transfer belt 51 is increased due to separation or the like of the external additive deposited on the toner.

As shown in (b) of FIG. 10, in this embodiment, in order to restore the lowered transfer efficiency, the pressure at the secondary transfer portion T2 is increased stepwisely with the increase of the cumulative output sheet number. In order to obtain an effect on the curve shown in (a) of FIG. 10, the pressure at the secondary transfer portion T2 is stepwisely approximated as shown in (b) of FIG. 10. The pressure is 50 N (5 kgf) at 0 k-30 k sheets, 60 N at 30 k-60 k sheets, 70 N at 60 k-90 k sheets and 80 N at 90 k sheets or more.

As shown in (b) of FIG. 10, as a result of the increase of pressure at the secondary transfer portion T2, as indicated by a solid line in (a) of FIG. 10, the lowering of the transfer efficiency with the increase of the cumulative output sheet number with the low image ratio is suppressed. As indicated by the solid line in (a) of FIG. 10, it is understood that the transfer efficiency is not lowered to a level less than about 90% by increasing the pressure even when the cumulative output sheet number is increased.

Incidentally, in the case where the pressure at the secondary transfer portion T2 is kept constant from the start at 50 N (5 kgf), the lifetime (durability) sheet number of the intermediary transfer belt 51 having the elastic layer 51*f* is 500 k (500,000) sheets. On the other hand, in the case where the pressure at the secondary transfer portion T2 is kept constant from the start at 80 N (8 kgf), abrasion or bending fatigue of the surface layer is increased, so that the lifetime (durability) sheet number is lowered. The image defect occurs at about 440 K sheets, so that the lifetime (durability) sheet number is lowered by about 60 k sheets.

On the other hand, in the case where the pressure is increased stepwisely as described above, the lifetime (durability) sheet number of the intermediary transfer belt 51 having the elastic layer 51*f* is 500 k sheets similarly as in the case of the pressure kept constant at 50 N (5 kgf).

As shown in (c) of FIG. 10, when the pressure at the secondary transfer portion T2 is increased, the image length with respect to the conveyance direction is elongated and therefore the image magnification of the electrostatic image is adjusted depending on the increase of the cumulative output sheet number, so that the change of the length of the image on the recording material with respect to the conveyance direction is cancelled.

With the stepwise pressure change as shown in (b) of FIG. 10, in the stage of the electrostatic image, the image magnification control is effected similarly as in Embodiment 1. As shown in (c) of FIG. 10, the image magnification of the electrostatic image with respect to the inputted image is set correspondingly to the set value of the pressure. That is, the image magnification is set at 100% for 0 k-30 k sheets, 99.9% for 30 k-60 k sheets, 99.8% for 60 k-90 k sheets and 99.7% for 90 k sheets or more.

As a result, as described in Embodiment 1, the electrostatic image formed on the photosensitive drum 1*a* is controlled depending on the pressure, so that it was confirmed that the final image magnification on the recording material was kept at 100% until the end of the lifetime (durability) sheet number.

By effecting the control as described above, even in the case where the durability sheet number is increased, it becomes possible to keep the density of the outputted image without increasing the toner amount per unit area on the photosensitive drum 1*a*. At the same time, it becomes possible to suppress the change of the image magnification of the outputted image.

Embodiment 3

Parts (a) to (c) of FIG. 11 are illustrations of control of the pressure and the image magnification in Embodiment 3. In this embodiment, in the image forming apparatus 100 shown in FIG. 1, in addition to the control in Embodiment 1, the elongation of the toner image, due to a difference of environmental temperature and humidity, with respect to the conveyance direction during the secondary transfer is canceled. A basic constitution in this embodiment is the same as that in Embodiment 1 and therefore the same constituent portions (means) as those in Embodiment 1 are represented by the same reference numerals or symbols and will be omitted from redundant description. A characteristic portion in this embodiment will be described below.

The controller 65 shortens the length of the toner image for the image with respect to the rotational direction of the intermediary transfer belt with the increase of the environmental temperature. In a high temperature and high humidity environment, the length of the toner image for the image with respect to the intermediary transfer belt rotational direction is made shorter than that in a low temperature and low humidity environment.

As shown in (a) of FIG. 11, as described in Embodiment 1, setting of the pressure switched at two levels depending on the type of the recording material was made. In this case, with the increase of the temperature and humidity, the elastic layer 51*f* of the intermediary transfer belt 51 is softened and therefore the elongation of the image length with respect to the conveyance direction during the secondary transfer is increased, so that the image magnification tends to increase. Temperature and humidity environments are set as follows.

(1) NL: 23° C. and 5% RH
(2) NN: 23° C. and 50% RH
(3) HH: 30° C. and 80% RH

Further, in FIG. 11, a plot of "■" represents the image magnification in the case of the pressure of 50 N (5 kgf), and a plot of "o" represents the image magnification in the case of the pressure of 75 N (7.5 kgf). In either plot, the image magnification is increased with the higher temperature and higher humidity condition. However, in the case of the pressure of 75 N, the pressure is higher than 50 N and correspondingly the elongation with respect to the conveyance direction is increased and thus the image magnification is further increased.

As shown in (b) of FIG. 11, similarly as in Embodiment 1, by adjusting the image magnification of the electrostatic image depending on the pressure, the image magnifications in the plots of "■" for the pressure of 50 N and "o" for the pressure of 75 N in each of the temperature and humidity environments can be made equal to each other. In each environment, the image magnification of the electrostatic image formed on the photosensitive drum 1*a* with respect to the inputted image was controlled as follows.

(1) NL: 99.68%
(2) NN: 99.43%
(3) HH: 99.24%

As a result, the plot of "o" for the pressure of 75 N substantially overlaps with the plot of "■" for the pressure of 50 N, so that it can be said that the change of the image magnification in the case of the fixed environment is suppressed.

Then, as shown in (c) of FIG. 11, by adjusting the image magnification of the electrostatic image depending on the temperature and humidity environment, the image magnifications in the plots of "■" for the pressure of 50 N and "o" for the pressure of 75 N in all of the temperature and humidity environments can be made equal to each other. That is, even when the pressure is changed and even when the temperature and humidity are changed, the outputted image with the same length on the recording material with respect to the conveyance direction is obtained by using the intermediary transfer belt 51 having the elastic layer 51*f*. In each environment, the image magnification of the electrostatic image formed on the photosensitive drum 1*a* with respect to the inputted image was controlled as follows.

<Pressure: 50 N>
(1) NL: 100.19%
(2) NN: 100%
(3) HH: 99.62%<
Pressure: 75 N>
(1) NL: 99.87%
(2) NN: 99.43%
(3) HH: 99.86%

In this embodiment, in both of the cases of the pressures of 50 N and 75 N at the secondary transfer portion T2, the image magnification of the electrostatic image formed on the photosensitive drum 1*a* is controlled. The image magnification of the electrostatic image in each of the environments at the pressure of 50 N and the image magnification of the electrostatic image at each of the environments at the pressure of 75 N are optimized, so that the image magnification of the image on the recording material with respect to the conveyance direction is 100% in either condition. As a result, all the plots substantially overlap with each other at the image magnification of 100%, so that it can be said that the image magnification change when the pressure at the secondary transfer portion T2 is changed in all the environments can be suppressed.

As described above, according to the present invention, the toner image forming means form the toner image and carries the toner image on the intermediary transfer member so as to cancel the elongation and contraction of the image with respect to the conveyance direction due to the change of the pressure at the transfer portion. For this reason, even when the length of the toner image for the image with respect to the rotational direction is changed with the change of the pressure at the transfer portion, the length of the image transferred on the recording material is reproduced substantially equally.

Therefore, while meeting the recording materials of the wide variety of types by changing the pressure at the transfer portion, the length of the image on the recording material with respect to the rotational direction can be precisely controlled with high reproducibility.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 280198/2010 filed Dec. 16, 2010, which is hereby incorporated by reference.

What is claimed is:

1. An image forming apparatus comprising:

an intermediary transfer member having an elastic layer;

toner image forming means for forming a toner image of an image to be carried on said intermediary transfer member;

a transfer member, which presses said intermediary transfer member, for transferring the toner image of the image from said intermediary transfer member onto a recording material;

a pressing mechanism capable of changing pressure applied from said transfer member to said intermediary transfer member; and control means for controlling said toner image forming means so that a length of the toner image of the image on said intermediary transfer member with respect to a rotational direction of said intermediary transfer member is decreased with an increase of the pressure.

2. An apparatus according to claim 1, wherein said control means increases the pressure with an increase of surface roughness and decreases the length of the toner image for the image with respect to the rotational direction of said intermediary transfer member with the increase of surface roughness.

3. An apparatus according to claim 1, wherein with respect to the recording material having embossed surface unevenness, said control means makes the pressure higher than that for plain paper and also makes the length of the toner image of the image with respect to the rotational direction of said intermediary transfer member shorter than that for the plain paper.

4. An apparatus according to claim 1, wherein with an increase of a cumulative output sheet number in image formation, said control means increases the pressure and decreases the length of the toner image for the image with respect to the rotational direction of said intermediary transfer member.

5. An apparatus according to claim 1, wherein with an increase of an ambient temperature, said control means decreases the length of the toner image for the image with respect to the rotational direction of said intermediary transfer member.

6. An apparatus according to claim 1, wherein said control means makes the length of the toner image of the image with respect to the rotational direction of said intermediary transfer member shorter in a high temperature and high humidity environment than that in a low temperature and low humidity environment.

* * * * *